US005142887A

United States Patent [19]

Priem et al.

[11] Patent Number: 5,142,887

[45] Date of Patent: Sep. 1, 1992

[54] RESONANT WAVE-JET AGITATOR WASHING MACHINE

[76] Inventors: Richard J. Priem, 13533 Mohawk Trail, Cleveland, Ohio 44130; John P. Wanhainen, 21391 Erie Rd., Rocky River, Ohio 44116

[21] Appl. No.: 690,637

[22] Filed: Apr. 24, 1991

[51] Int. Cl.[5] ..... D06F 17/00

[52] U.S. Cl. ..... 68/18 FA; 68/184

[58] Field of Search ..... 68/3 SS, 18 F, 18 FA, 68/53, 184, 207; 134/111, 188, 191, 193, 195

[56] References Cited

U.S. PATENT DOCUMENTS

| | | | |
|---|---|---|---|
| 2,157,695 | 5/1939 | Fulton | 134/188 X |
| 2,652,844 | 9/1953 | Van Hise | 134/188 |
| 2,711,641 | 6/1955 | Groff | 68/184 |
| 2,873,600 | 2/1959 | Demaret | 68/184 X |
| 2,969,665 | 1/1961 | Saverio | 68/184 |
| 3,048,994 | 8/1962 | Welter | 68/184 |
| 3,444,710 | 5/1968 | Gauler et al. | 68/184 |
| 3,867,821 | 2/1975 | Hurvitz | 68/184 |
| 4,077,239 | 3/1978 | Platt et al. | 68/53 |
| 4,402,198 | 9/1983 | Cartier | 68/18 FA |
| 4,419,870 | 12/1983 | Brenner | 68/18 FA |
| 4,420,952 | 12/1983 | Brenner et al. | 68/53 |
| 4,744,228 | 4/1988 | Goldberg | 68/184 X |

FOREIGN PATENT DOCUMENTS

| | | | |
|---|---|---|---|
| 195880 | 2/1958 | Austria | 68/53 |
| 844734 | 7/1952 | Fed. Rep. of Germany | 68/53 |
| 1017912 | 10/1952 | France | 68/53 |
| 1124305 | 6/1956 | France | 68/184 |

*Primary Examiner*—Philip R. Coe

[57] ABSTRACT

Now discovered that a resonance rotating wave sustained by a rotating fluid jet can achieve a high level of agitation as required in washing devices. The rotating fluid wave is created by one or more constant flow rotating fluid jets that are rotating at a speed near the natural frequency of a wave in the washing chamber. The rotating fluid jets are produced by a pump mounted within a rotating nozzle housing within the main washing container. The nozzle housing with pump, flow passages and nozzles is rotated to produce the rotating fluid jets. Since only rotational motion is used to produce agitation with the resonant wave-jet agitator washing machine the mechanical components are greatly simplified as compared to a conventional oscillating motion washing machine.

10 Claims, 4 Drawing Sheets

RESONANT WAVE-JET AGITATOR WASHING MACHINE

BACKGROUND OF THE INVENTION

Field of Invention

This invention relates generally to the use of a rotating fluid jet to produce a rotating fluid wave in the washing fluid which provides localized fluid motion or agitation for efficient washing. In an illustrated embodiment rotating fluid jets are used to produce rotating fluid waves in a top loading clothes washer.

It is known to use in washing machines different types of liquid flow systems to improve agitation which include the following:

U.S. Pat. No. 3,444,710 discloses a fluid flow agitation system in which an external pump is used to recirculate the fluid with a fluid amplifier to create a pulsating jet flow into the washer and thereby produce a high level of agitation.

U.S. Pat. No. 3,867,821 discloses a modulated recirculation system in which an external centrifugal pump is used with a mechanically modulated nozzle to produce a spatially unsymmetrical field of turbulence which sweeps cyclical around the spin basket.

U.S. Pat. No. 4,744,228 also discloses a recirculating flow system with an external pump to supply a venturi conduit in the bottom of the tub which produces a toroidal flow of fluid in the spin basket.

Numerous disclosures have been made for pumping a portion of the wash fluid with the oscillating agitator to enhance washing action in an automatic washing machine. The most recent are disclosed in U.S. Pat. Nos. 4,420,952: 4,419,870: 4,402,198 and 4,077,239. In these disclosures the oscillating motion of the mechanical agitator is used to obtain pumping so that some of the fluid can be filtered and discharged at the top of the agitator. These disclosures use check valves, flapper valves, positive displacement pumps and ram or inertia forces in various combinations to produce the fluid motion. In these disclosures the main wash fluid agitation is produced by a mechanical oscillating motion agitator as used in conventional washing machines.

SUMMARY OF INVENTION

Now discovered that a resonance rotating wave sustained by a rotating fluid jet can achieve a high level of agitation as required in washing devices. The circumferential rotating fluid wave provides local radial, vertical and circumferential motion in the washing fluid and thereby produces the high level of agitation. The rotating fluid wave is created by one or more constant flow fluid jets that are rotating at a speed near the natural frequency of a rotating fluid wave in the washing chamber. The rotating fluid jets are produced by a centrifugal or positive displacement pump mounted within a rotating nozzle housing within the main washing container. The nozzle housing with pump and nozzles is rotated to produce the rotating fluid jets. The nozzle housing and pump are driven by concentric shafts with pulleys and belts, or gears, from a motor with appropriate speed reductions to obtain the desired rotating fluid wave. Motor speed is varied to obtain varying flows of fluid from the pump which in turn varies the rotating fluid wave amplitude, fluid motion and agitation level in the washing fluid. A conical shaped fairing mounted on the rotating nozzle housing contains flow passages and a filter through which part of the wash fluid is pumped and then sprayed as streams on the top of the fluid wave to improve the amplitude of the fluid wave and washing action. Since only rotational motion is used to produce the necessary agitation, the mechanical components are greatly simplified as compared to a conventional oscillating motion agitator washing machine. Also the material being washed is not subjected to mechanical or abrasive forces as associated with conventional oscillating motion agitators with vanes.

BRIEF DESCRIPTIONS OF THE DRAWINGS

Figure 3:
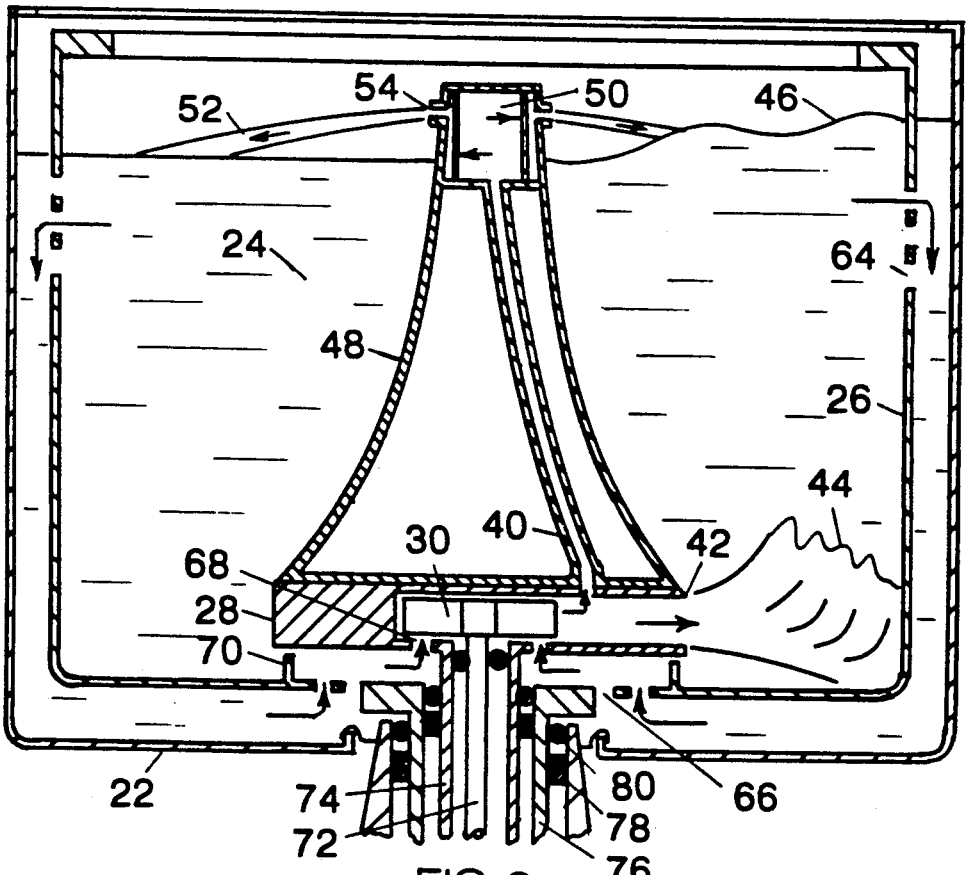
FIG. 3 is a vertical cross sectional view of the resonant wave-jet agitator assembly within the washing chamber and basket of a conventional washing machine using a radial flow jet.
Figure 3A:
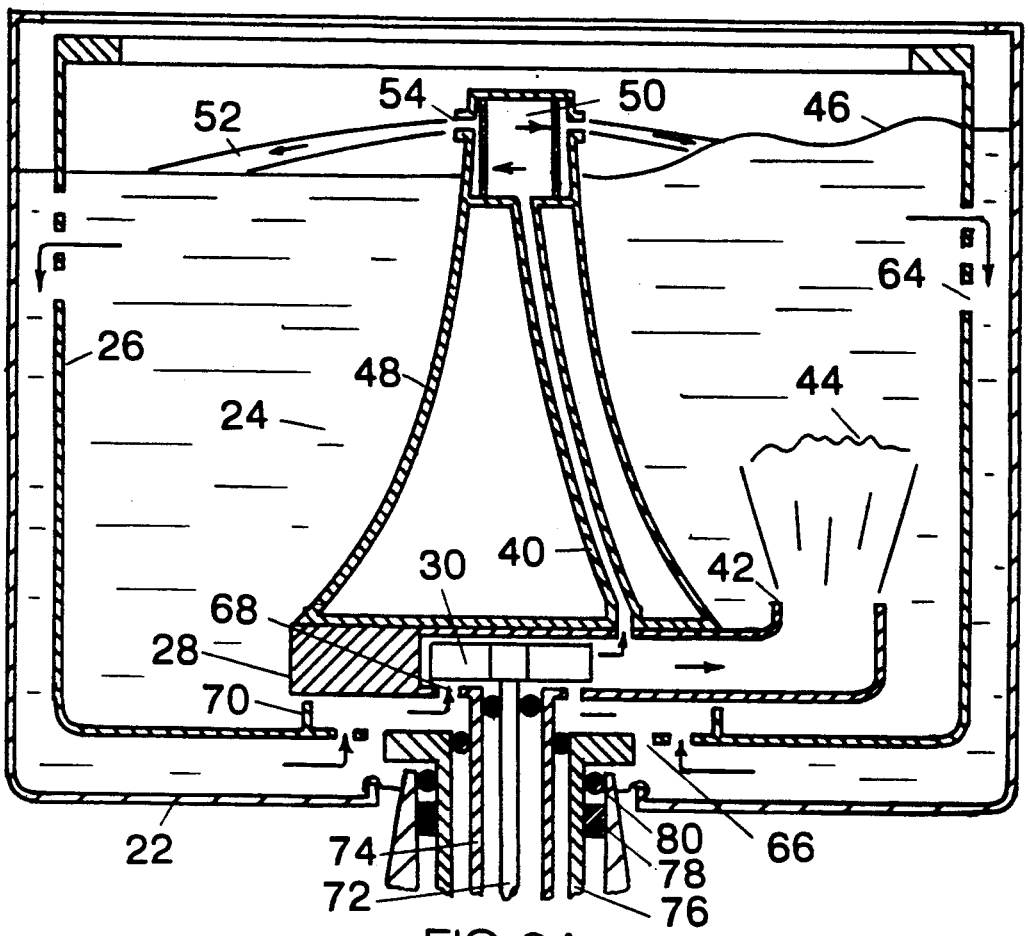

FIG. 3*a* is a vertical cross section view of the resonant wave-jet agitator assembly using a vertical flow jet.

Figure 4:
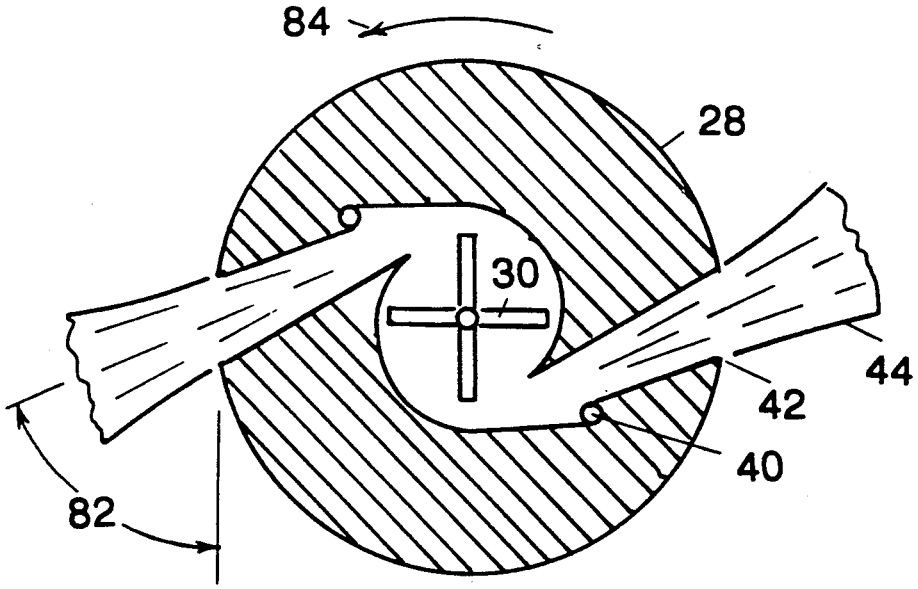

FIG. 4 is a cross sectional view of the rotating nozzle housing showing a centrifugal pump and nozzles that produce the rotating fluid jets.

Figure 5:
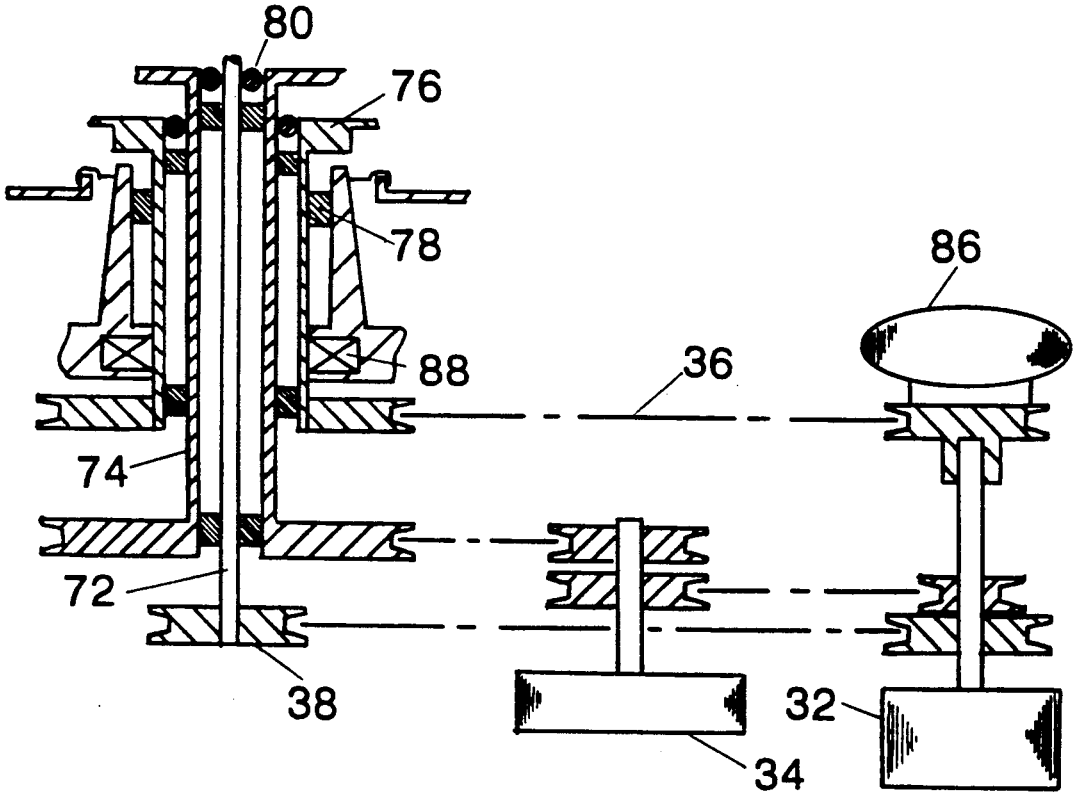

FIG. 5 is a schematic view showing a drive assembly for the rotating nozzle housing, pump and basket.

DETAILED DESCRIPTION OF THE PREFERRED EMBODIMENT

Figure 1:
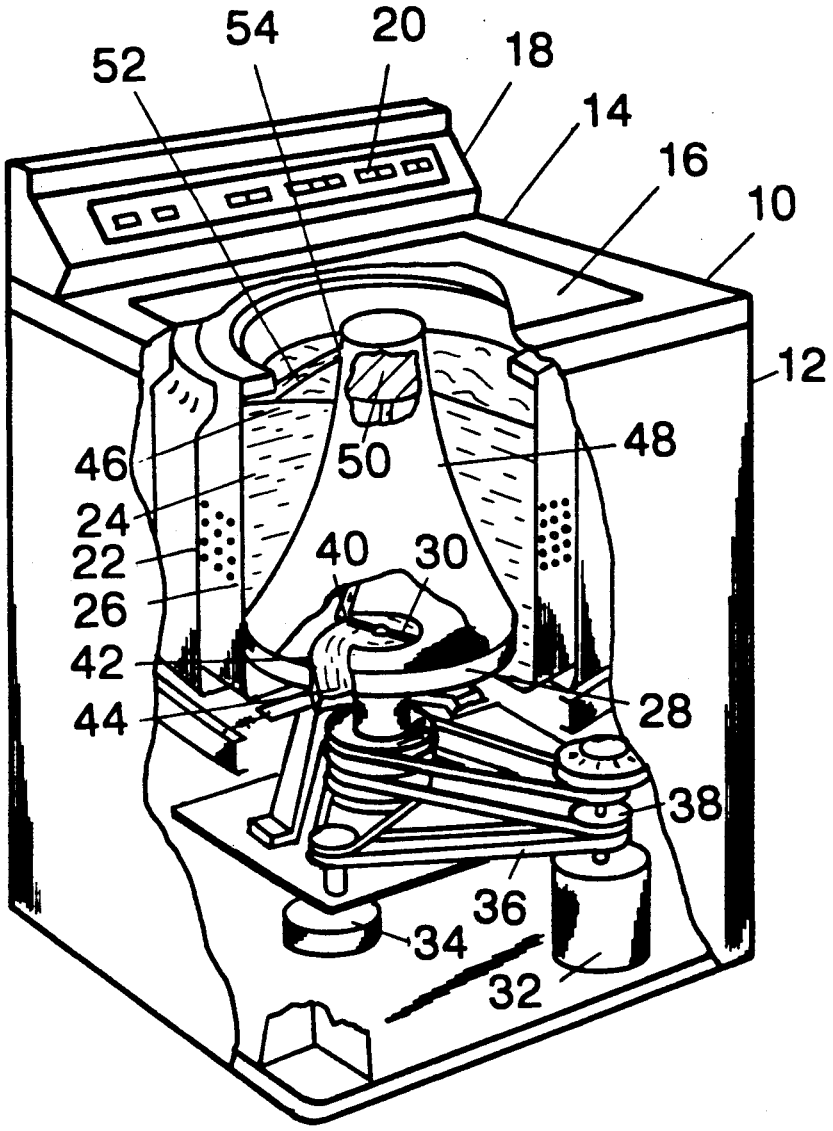
FIG. 1 is a perspective view of a washing machine embodying the present invention, partially cut away to show the interior mechanism thereof.

The principles of this invention are depicted in FIG. 1 in which the concept is used in a top loading washing machine, more specifically a clothes washer (10). The washer (10) is comprised of a cabinet (12) having a top (14) with a lid (16), console (18) and controls (20) thereon. Housed within the cabinet (12) is a washing chamber (22) which contains the fluid (24) used for washing. Included in the washing chamber (22) is a clothes container or basket (26).

Within the washing chamber (22) is a rotating nozzle housing (28) which contains a centrifugal or positive displacement pump (30). The rotating nozzle housing (28) and pump (30) each rotate independently of the basket (26).

Below the washing chamber (22) and within the cabinet (12) is provided a motor (32) which drives the basket (26), the rotating nozzle housing (28), the pump (30) and the discharge pump (34) via belts (36) and pulleys (38). Gears may also be used to connect the motor (32) to the drive assemblies.

The rotating nozzle housing (28) has one or more nozzles (42) that direct fluid from the pump (30) to flow radially outward or vertically upward from the rotating nozzle housing (28) to produce rotating fluid jets (44) which excite and sustain a rotating fluid wave (46) within the washing chamber (22) and basket (26) assembly. A rotating fluid wave is similar to a surface wave wherein the fluid wave has a maximum height followed by a minimum height. With a rotating fluid wave the wave maximums and wave minimums travel circumferentially around the washing chamber (22). The number of wave maximums and minimums correspond to the number of rotating fluid jets. The waves are equally spaced around the washing chamber (22) and the end of one wave is the beginning of another. The wave height maximizes at the outer wall of the washing chamber

(22) and decreases in height towards the center. Without a center body inside the washing chamber (22) the wave height is zero at the center of the washing chamber (22).

Above the rotating nozzle housing (28) is a conical shaped fairing (48) that can be mounted to the basket (26) or attached to the rotating nozzle housing (28). The fairing (48) contains flow passages (40) that directs a portion of the wash fluid (24) from the pump (30) to a filter (50) and then discharged as a stream (52) thru orifices (54) in the upper portion of the rotating conical shaped fairing (48).

Figure 2:
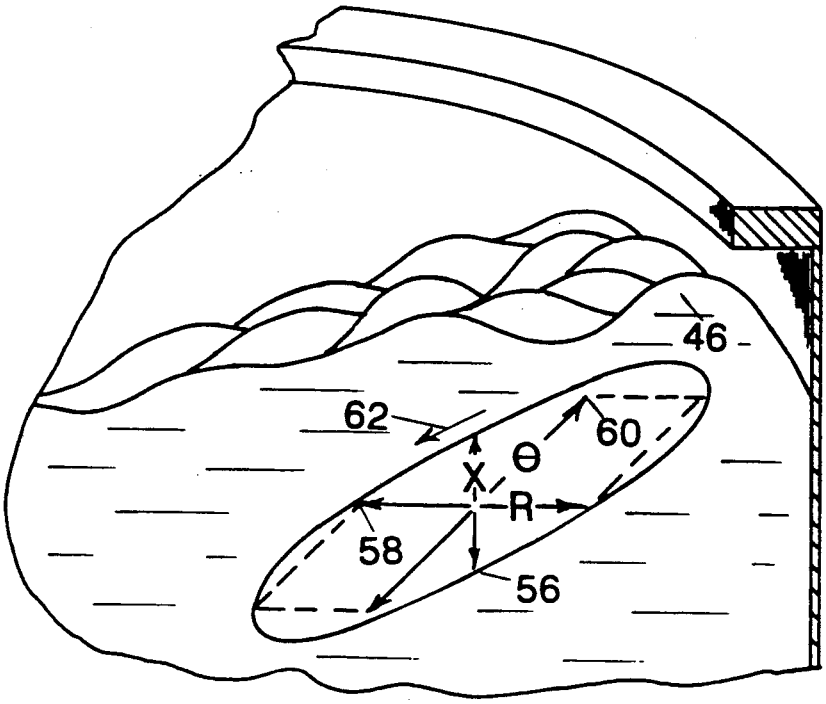
FIG. 2 is a schematic view showing the fluid motion associated with the rotating fluid wave.

The rotating fluid wave (46) produces fluid particle motion in the wash fluid as shown in FIG. 2. The rotating fluid wave (46) produces vertical {"X"} motion (56), radial {"R"} motion (58) and circumferential {"θ"} 56 motion (60) of fluid particles. The fluid motion is dependent on the wave amplitude, i.e. difference between the maximum wave height and minimum wave height. The wave amplitude in turn is dependent on the rotational speed and fluid flow rate of the rotating fluid jets (44). Maximum wave amplitude is achieved at the natural frequency of the rotating fluid wave (46) which is determined by the fluid (24) depth and diameter of the washing chamber (22). A rotating fluid wave (46) with an amplitude of 1 inch produced a vertical fluid particle motion (56) of 1 inch, a radial particle motion (58) of 1½ inches and a circumferential particle motion (60) of 2 inches.

FIG. 2 illustrates the fluid particle motion within the wash fluid (24) as a function of time (62). The fluid particle moves in an elliptical path once each time the rotating fluid wave (46) passes a specific location. With two rotating fluid jets (44) and two rotating fluid waves (46) two maximum amplitude points are present at all times within the washing chamber (22). At the natural frequency of the rotating fluid wave (46), which is near 45 rpm for a typical washing machine, a wave will therefore come by 90 times per minute while a fluid particle completes one revolution of the ellipse shown in FIG. 2 in ⅔ of a second. While a single rotating fluid jet (40) will produce a rotating fluid wave (46), and the necessary agitation of the wash fluid (24) for efficient washing, the single rotating fluid jet (44) and rotating fluid wave (46) will also produce a large load unbalance in the washing chamber (22) of the washer (10). Therefore an application of two or more rotating fluid jets (44) is recommended.

With this invention all the agitation is produced by the fluid motion associated with the rotating fluid wave (46) and rotating fluid jet (40). The fluid particle movement is always in three directions; vertical {"Z"} motion (56), radial {"R"} motion (58) and circumferential {"0"} motion (60). Therefore the fluid (24) moves into all parts of the material being washed. Since the speeds of the pump (30) and rotating nozzle housing (28) control the amplitude of the rotating fluid wave (46), varying degrees of washing intensity from very gentle to extreme can be obtained by simply changing the motor (32) speed. With only rotating motion used to produce the necessary agitation the mechanical components of the resonant wave-jet agitator (meaning agitation by fluid WAVES that are rotating within the washing chamber at the RESONANCE frequency and these waves are produced by rotating fluid JETs) washing machine are greatly simplified as compared to a conventional oscillating motion washing machine. With the resonant wave-jet agitator the material being washed is not subjected to mechanical or abrasive forces as associated with mechanical agitation.

In the cross section view of FIG. 3 a particularly preferred application of the present invention in a top loading clothes washer (10) is shown with a single rotating fluid jet (44), a nozzle (42), and a single rotating fluid wave (46). A single rotating fluid jet (44) is used herein to simplify the drawings. Two or more rotating fluid jets (44) are recommended. The invention can also be used for other applications where agitation by fluid motion is desired and with fluids other than water, i.e. dry cleaning with special dry cleaning fluids, or cleaning of mechanical parts with solvents, etc.

As shown in FIG. 3, a centrifugal or positive displacement pump (30) is used to circulate fluid (24) within the washing chamber (22). Fluid (24) from the pump (30) is discharged through nozzles (42) from the rotating nozzle housing (28) near the bottom of the washing chamber (22) in the form of rotating fluid jets (44). The high velocity rotating fluid jets (44) force the fluid (24) to rise at that location and thereby excites and sustains the rotating fluid wave (46) that has a peak amplitude at that position and time (62). Fluid flows through discharge ports (64) in the basket (26) into the space between the walls of the basket (26) and washing chamber (22) and then toward the bottom center of the washing chamber (22). Located at the bottom center of the basket (26) are inlet ports (66) allowing fluid to enter the pump inlet (68) and thereby complete the circuit for the fluid flow. A labyrinth type seal (70) between the bottom of the rotating nozzle housing (28) and basket (26) prevents fluid from circulating directly from the rotating fluid jet (44) back into the pump inlet (68).

From the top of the pump (30) and nozzle housing (28), a portion of the fluid is allowed to flow upward via flow passages (40) through the conical shaped fairing (48). This fluid passes through a filter (50) which removes the lint and dirt, etc. being carried by the fluid (24) and thereby provides purification of the wash fluid (24) for better washing. The filtered fluid flows out of the rotating conical shaped fairing (48) at the top through spray orifices (54) to produce rotating streams (52). The streams (52) continually spray fluid on the rotating fluid wave (46) at the maximum amplitude point and thereby enhances the wave motion. These streams (52) improve the washing action by increasing the rotating wave (46) amplitude and also assist in obtaining the desired motion of the clothes. The streams (52) are synchronized with the rotating fluid wave (46) to produce maximum amplitude of the rotating fluid wave (46).

The pump (30) and nozzle housing (28) are driven by concentric pump drive shaft (72) and nozzle housing drive shaft (74) within the basket drive shaft (76). The nozzle housing (28) could also be driven from the pump drive shaft (72) via gears. Separate motors (32) could also be used to drive the pump drive shaft (72), nozzle housing drive shaft (74) and basket drive shaft (76). Appropriate bearings (78) and rotating shaft seals (80) are used to provide sealing of the fluid (24) within the washing chamber (22) and to obtain alignment and easy rotary motion. A basket (24) is used as in conventional washers which is normally spun to remove fluid (24) from the clothes at the end of the washing cycle(s).

In FIG. 3 a radial rotating fluid jet (44) orientation is depicted. FIG. 3*a* shows a vertical orientation of the rotating fluid jet. A vertical orientation is equally effective in exciting and sustaining a rotating wave. The vertical orientation requires a larger rotating nozzle housing therefore the radial orientation is the preferred embodiment.

FIG. 4 shows a cross section view of the nozzle housing (28) which contains the pump (30), flow passages (40) and nozzles (42). The pump (30) provides flow for the rotating fluid jets (44) by raising the pressure of the fluid. The size and speed of the pump (30) can be changed to vary the flow in the rotating fluid jets (44) and thereby control the amplitude of the rotating fluid wave (46) and washing action.

The nozzle housing (28) contains the nozzles (42) to direct the flow from the pump (30) for the rotating fluid jets (44). In the configuration shown in FIG. 4, two nozzles (42) are used to form two rotating fluid jets (44) so that two rotating fluid waves (46) with two maximum wave amplitudes are present to obtain the preferred configuration of two or more waves as discussed above.

The contour of the nozzles (42) controls the direction of the rotating fluid jet (40) flow. An average circumferential flow, which slowly moves the wash fluid (24) around the washing chamber (22), over many cycles of the fluid wave, may be desired to control the motion of material being washed. This average circumferential flow is controlled by the angle (82) the fluid jet makes with the tangent to the rotating nozzle housing. If the flow angle (82) is small and in the direction of rotation (84) a large average circumferential flow will occur in the washing chamber (22) in the direction of rotation (84). With a large flow angle (82), whereby the rotating jet is flowing backward, the average circumferential flow will be opposite to the direction of rotation (84) of the nozzle housing (28). The flow angle (82), and thereby the average circumferential flow, is used to control the motion of the clothes (or material being washed). The area of the nozzle (42) for the rotating fluid jets (44) is used to control the velocity of the fluid in the rotating fluid jets (44). With smaller nozzles (42) the velocity is increased and a large torroidal motion of the washing fluid in the washing container is produced. With torroidal motion the fluid slowly rotates in a plane along a radius of the washing chamber (22). Excessive torroidal motion is undesirable as it tangles the clothes. A small torroidal motion is desirable to produce a slow movement of the clothes for efficient and uniform washing.

The drive mechanism for the various components of the washer (10) is shown schematically in FIG. 5. All power can be provided by one motor (32), which is reversible and can have variable speeds. Using appropriately sized pulleys (38) with belts (36) the desired rotational speeds of the pump drive shaft (72), the nozzle housing drive shaft (74), the basket drive shaft (76) and the discharge pump (34) are obtained for a given motor (32) speed. Gears can also be used to connect the drive shafts to the motor (32).

Standard techniques can be used to control the discharge pump (34) and basket drive shaft (76) so that they do not operate during the wash cycle. In the embodiment shown a fluid clutch (86) and a friction brake (88) are used to isolate the basket drive shaft (76) so that it does not rotate with the normal direction of motor (32) rotation. The fluid clutch (86) produces positive torque when the motor (32) is reversed. The friction brake (88) produces positive locking action of the basket drive shaft (76) when the motor (32) is turning in the normal direction. In the embodiment shown herein, washing action occurs with the presence of a rotating fluid wave (46) whenever the motor (32) is turning. Spin action to remove fluid from the clothes occurs when the motor (32) direction is reversed.

Conventional bearing (78) and rotating shaft seal (80) concepts are used used for the nozzle housing drive shaft (74), pump drive shaft (72) and basket drive shaft (76) to assure easy movement, alignment and prevent leaking of the fluid (24) from the washing chamber (22).

In illustration of the foregoing application of using a fluid jet to produce a rotating fluid wave with appropriate fluid motion to obtain good washing action, a washing machine was provided with a basket 20 inches in diameter and 14 inches deep. The perforated basket was enclosed in a 24 inch diameter washing chamber (tub) mounted in a conventional washing machine. A cylindrical nozzle housing which contained a 4 inch diameter dual outlet centrifugal pump, two fluid jet flow passages and two nozzles was installed within the basket. Concentric shafts with appropriate bearings and seals were installed to support and drive the basket, the nozzle housing and pump. A friction brake and fluid clutch from a conventional automatic washing machine was used to stop rotation of the basket during the wash cycle. Ports were machined into the bottom center of the basket to allow recirculation of the wash fluid from the tub to the pump inlet. A labyrinth type seal was installed between the nozzle housing and basket to prevent fluid from circulating directly from the rotating fluid jets back into the pump inlet. Reversing the rotation of the motor provides normal motion of the basket to remove fluid from the clothes and tub via the discharge pump. A single reversible ½ hp motor with a fluid clutch was used with pulleys and belts to turn the basket, the nozzle housing, the centrifugal pump and the discharge pump. The nozzle housing was rotated at 45 rpm and the centrifugal pump, which provided flow to two rotating fluid jets, at 1600 rpm.

The basket was filled with 20 gallons of hot water to a depth of 12 inches along with 6 lb. of clothes. A rotating fluid wave with a wave amplitude of 1 inch on the wall was produced with rotating fluid jet flow of 150 gallons per minute. Movement of the clothes at the surface and 2 inches from the wall was 1 inch in the vertical direction, 1½ inches in the radial direction and 2 inches in the circumferential direction for each rotating fluid wave. The clothes did not become entangled, but did move at 1 rpm in the same direction as the rotating nozzle housing, and had some movement from top to bottom. To test the washing capability of the agitation produced by the rotating fluid waves, two identical samples of soiled clothes (with varying degrees of mud and oil) were prepared. One sample of soiled clothes was washed with the resonant wave-jet agitator washing machine described in this disclosure and the other was washed in a conventional washing machine with the same water temperature, type and quantity of soap and washing time. Examination of the clothes after washing and spin drying showed that the resonant wave-jet agitation extracted more soil than the conventional washer.

In other applications it may be desirable to use the resonant wave-jet agitation system only within a washing chamber (22) to produce agitation within a fluid. The resonant wave-jet agitation system would then include the nozzle housing (28), pump (30), rotating fluid jets (44), nozzles (42), flow passages (40) and a motor (32) with appropriate means of obtaining the desired speeds for the pump drive shaft (72) and nozzle housing drive shaft (76). The rotating fluid wave (46) would then be produced within the fluid to provide the desired agitation.

While the invention has been shown and described with respect to a particular embodiment thereof, this is for the purpose of illustration rather than limitation. Variations and modifications of the specific embodiment herein shown and described will be apparent to those skilled in the art. All of these modifications are within the intended spirit and scope of the invention. Accordingly, the patent is not to be limited in scope and effect to the specific embodiment herein shown and described nor in any other way that is inconsistent with the extent to which the progress in the art has been advanced by the invention.

Having thus described the invention, it is now claimed:

1. A washing machine comprising a washing chamber means for containing a body of washing fluid and material to be washed including an access opening, a sidewall extending about a vertical axis and a bottom wall joined to said sidewall, a rotating nozzle housing containing a discharge nozzle means, a pump mounted within said rotating nozzle housing, a drive means operably connected to said pump, said pump having an inlet in fluid communication with said body of washing fluid and an outlet in fluid communication with said discharge nozzle means, said discharge nozzle means discharges at least one fluid jet of a high velocity flow of washing fluid below the level of said body of washing fluid in said washing chamber means, a drive means operably connected to said rotating nozzle housing for rotation movement thereof at an angular velocity corresponding with the natural frequency of a rotating wave in said body of washing fluid in said washing chamber means to form a resonance rotating fluid wave in said body of washing fluid.

2. An apparatus as set forth in claim 1, wherein said discharge nozzle means discharges radially from said rotating nozzle housing toward said sidewall of said washing chamber means to drive said rotating fluid wave.

3. An apparatus as set forth in claim 1, wherein said discharge nozzle means discharges vertically upward from said rotating nozzle housing along said sidewall of said washing chamber means to drive said rotating fluid wave.

4. An apparatus as set forth in claim 1, wherein said discharge nozzle means discharges at least a second fluid jet of said washing fluid, and said drive means also rotates said second fluid jet around said vertical axis to form a second rotating fluid wave in said body of washing fluid.

5. An apparatus as set forth in claim 4, wherein more than one said rotating fluid waves tend to impose balance centrifugal forces on said washing chamber means.

6. An apparatus as set forth in claim 1 wherein said drive means comprises of a centrally disposed inner drive shaft extending into said washing chamber means for rotating said pump and an outer drive shaft concentric with said inner drive shaft and extending into said washing chamber means for

7. An apparatus as set forth in claim 1, wherein said washing chamber means further comprises of a basket with holes in the bottom and sidewall to allow recirculation of said washing fluid into said pump.

8. An apparatus as set forth in claim 1, wherein said rotating nozzle housing contains a centrally disposed conical shaped fairing mounted on said rotating nozzle housing with internal passages in fluid communication with outlet of said pump.

9. An apparatus as set forth in claim 8, wherein said conical shaped fairing includes spray orifices in fluid communication with said internal passages fluid above the level of said body of washing fluid.

10. An apparatus as set forth in claim 8 wherein said conical shaped fairing includes a filter in fluid communication with said internal passages for removal of entrained dirt and lint.

* * * * *